United States Patent [19]

Wepfer

[11] Patent Number: 4,637,457

[45] Date of Patent: Jan. 20, 1987

[54] BAFFLE PLATE WITH EIGHT-LOBED TUBE-RECEIVING OPENINGS AND COLD-FORMED FLOW-RESTRICTING TABS IN EACH LOBE

[75] Inventor: Robert M. Wepfer, Wilkinsburg, Pa.

[73] Assignee: Westinghouse Electric Corp., Pittsburgh, Pa.

[21] Appl. No.: 695,036

[22] Filed: Jan. 25, 1985

[51] Int. Cl.[4] ..... F28F 9/22

[52] U.S. Cl. ..... 165/162; 165/173

[58] Field of Search ..... 165/173, 162, 161

[56] References Cited

U.S. PATENT DOCUMENTS

| | | | |
|---|---|---|---|
| 911,156 | 2/1909 | Politz | 165/173 X |
| 1,992,504 | 2/1935 | Penniman | 165/161 X |
| 2,056,920 | 10/1936 | Demann | 165/162 X |
| 3,012,761 | 12/1961 | Gardner et al. | 165/162 X |
| 3,442,763 | 5/1969 | Chetter et al. | 165/162 X |
| 3,742,567 | 7/1973 | Kaelin | 165/162 X |
| 3,789,184 | 1/1974 | Piepers et al. | 165/162 X |
| 3,844,887 | 10/1974 | Georges et al. | 165/162 X |
| 4,120,350 | 10/1978 | Norton | 165/162 |
| 4,256,783 | 3/1981 | Takada et al. | 165/162 X |
| 4,285,396 | 8/1981 | Schowerer et al. | 165/162 |
| 4,423,703 | 1/1984 | Esselman et al. | 165/162 X |

FOREIGN PATENT DOCUMENTS

| | | | |
|---|---|---|---|
| 0125324 | 11/1984 | European Pat. Off. | 165/162 |
| 2339364 | 2/1975 | Fed. Rep. of Germany | 165/162 |
| 0149962 | 11/1979 | Japan | 165/162 |

OTHER PUBLICATIONS

Project Report, "Tube Support Plate Thermal and Hydraulic Testing", pp. 3–8, Electric Power Research Institute, May, 1983.

*Primary Examiner*—Albert W. Davis, Jr.
*Assistant Examiner*—Randolph A. Smith
*Attorney, Agent, or Firm*—L. A. DePaul

[57] ABSTRACT

In a nuclear steam generating vessel, a baffle plate disposed a slight distance above the tube sheet has a plurality of openings therethrough for respectively receiving the heat exchanger tubes. Each opening has a circular central portion and eight equally spaced peripheral lobe portions alternating with eight lands. The inner end of the lands lie on a circle have a diameter slightly greater than that of the associated tube. The upper and/or lower surface of the baffle plate is mechanically deformed adjacent to each lobe portion of each opening to displace material into the lobe portions and constrict the cross sectional areas thereof to limit liquid flow therethrough. The lands are dimensioned and arranged so that one or two at a time can contact the associated tube, while the constriction of the lobe portion flow areas limits liquid flow therethrough sufficiently to insure proper baffling operation of the baffle plate.

20 Claims, 5 Drawing Figures

FIG. 1
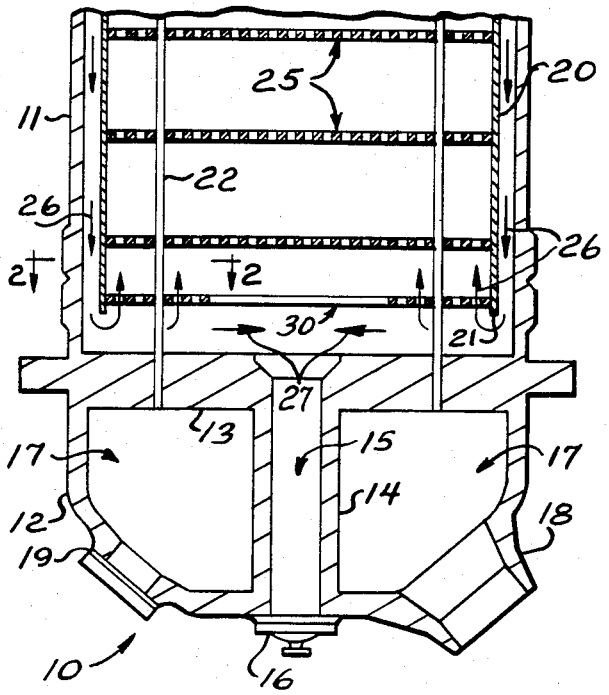
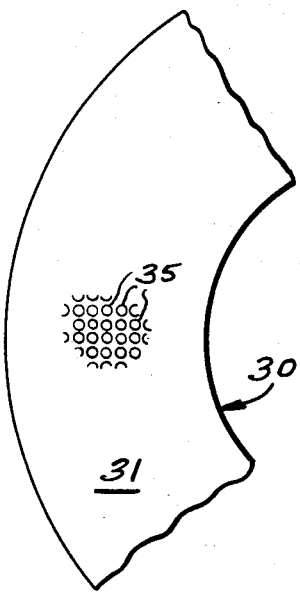
FIG. 2
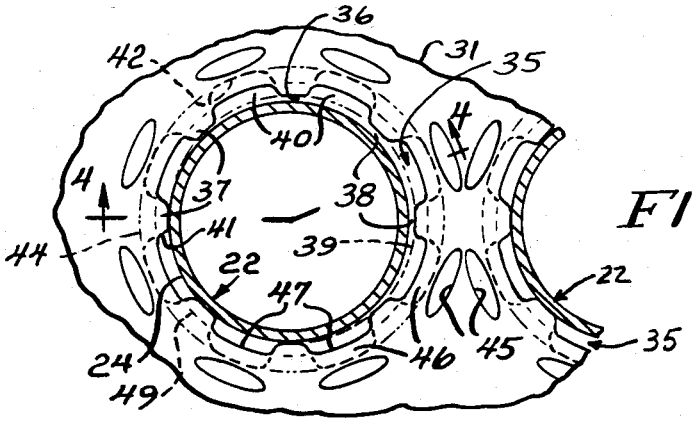
FIG. 3
FIG. 4
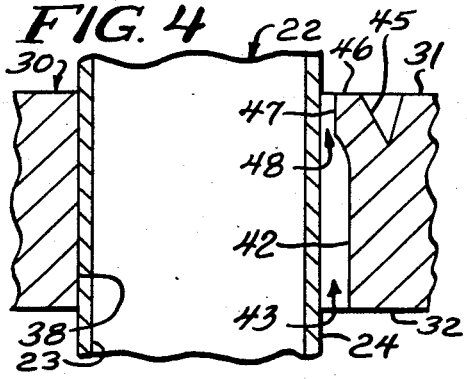
FIG. 5
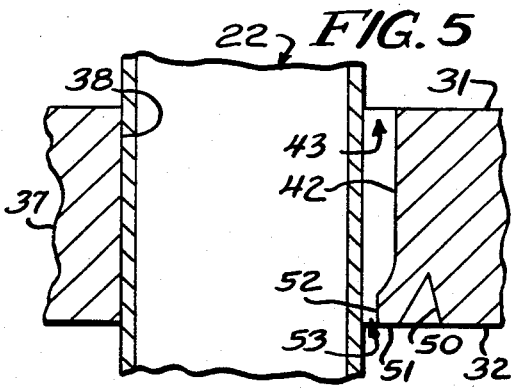

BAFFLE PLATE WITH EIGHT-LOBED TUBE-RECEIVING OPENINGS AND COLD-FORMED FLOW-RESTRICTING TABS IN EACH LOBE

BACKGROUND OF THE INVENTION

1. Field of the Invention

This invention relates to heat exchangers, for example, the heat exchangers of nuclear steam generators. In particular, the invention relates to baffle plates for such heat exchangers and techniques for forming the tube-receiving openings in such plates.

2. Description of the Prior Art

In one type of nuclear steam generator, primary coolant from a nuclear reactor flows through a bundle of inverted U-shaped tubes, which have their lower ends received in a tube sheet. A secondary coolant flows around the tubes in heat exchange relationship therewith. More particularly, the secondary coolant generally flows downwardly in an annulus along the outer periphery of the tube bundle to the tube sheet and then upwardly among the tubes. Particles of sludge tend to settle out from the secondary coolant and build up along the top of the tube sheet. These piles of sludge deposits contribute to corrosion of the tubes.

In order to minimize the buildup of sludge on the tube sheet, it is known to use a baffle plate a slight distance above the tube sheet to redirect a portion of the flow of the secondary coolant. More specifically, such a baffle plate is designed to impede the upward flow velocity and, therefore, tend to increase the laterally or radially inwardly directed flow velocity along the tube sheet. This increased lateral flow velocity tends to entrain sludge particles and prevent them from depositing on the tube sheet. The baffle plate has a plurality of openings therethrough for respectively accommodating the tubes, these openings being greater in diameter than the tubes to permit fluid flow through the openings along the outsides of the tubes. However, the tolerances are such that generally the tubes are not aligned exactly coaxially with the tube openings in the baffle plate.

The portion of the tube disposed in the tube opening co-operates with the surrounding portion of the baffle plate to define a generally annular flow channel, which is a volume bounded on the inside by the tube and on the outside by the perimeter of the tube opening in the baffle, and on the top and bottom by the planes of the upper and lower surfaces of the baffle plate. Typically one side of a tube will contact the baffle plate and, immediately on either side of the contact region, the cross-sectional area of the flow channel around the tube is insufficiently large to prevent the secondary coolant liquid which enters the channel from completely boiling dry before exiting the channel. This boiling condition results in deposition of sludge and corrodents in these crevice-shaped portions of the flow channels, which may lead to tube corrosion at these locations, a condition which is sometimes referred to as "crevice corrosion".

In order to minimize such crevice corrosion, it is known to provide the baffle plate with non-circular tube-receiving openings. One such arrangement utilizes an opening which has frustoconical portions at the upper and lower surfaces of the tube sheet which converge inwardly to an octagonal portion centrally of the baffle plate thickness. The tube can contact the baffle plate only along the flat sides of the octagonal portion of the opening. These flat sides tend to provide crevices on the opposite sides of the contact point which are wide enough to inhibit crevice corrosion. However, because of the thin axial extent of the octagonal portion of the opening, there is a tendency to produce excessive wear on the outer surface of the tube at the contact points.

An alternative arrangement which has been used is tube-receiving openings which are generally multi-lobed in shape, each opening having a plurality of radially inwardly directing protrusions which are designed to provide generally line contact with the associated tube. The lobed portions of the opening are designed so as to eliminate crevices and provide a substantial flow area so as to overcome crevice corrosion.

Such lobed tube openings have been relatively successful in minimizing crevice corrosion, but the flow volume through the tube openings is so great as to be of minimal use in redirecting the flow, i.e., in performing as a baffle plate.

SUMMARY OF THE INVENTION

It is a general object of the present invention to provide an improved baffle plate construction for a heat exchanger which avoids the disadvantages of prior baffle plate arrangements while affording additional structural and operating advantages.

An important object of the invention is the provision in a heat exchanger of a baffle plate which affords good flow-distribution baffling while at the same time effectively minimizing crevice corrosion effects.

In connection with the foregoing object, it is another object of this invention to provide a heat exchanger baffle plate of the type set forth which effectively reduces tube wear at the locations of tube contact with the baffle plate.

These and other objects of the invention are attained by providing in a heat exchanger including a pressure vessel closed at one end by a tube sheet and a plurality of heat exchange tubes within the vessel extending into the tube sheet for heat exchange between the interior of the tubes and a liquid flowing around the tubes in a flow path extending generally parallel thereto, the improvement comprising: a baffle plate disposed within the vessel and extending transversely thereof in the liquid flow path adjacent to the tube sheet, the baffle plate serving to limit liquid flow parallel to the tubes and to redirect at least a portion of the flow generally parallel to the tube sheet, the baffle plate having parallel upper and lower surfaces and a plurality of tube-receiving openings extending therethrough substantially perpendicular to the upper and lower surfaces for respectively receiving the tubes, each of the openings having a circular central portion dimensioned freely to accommodate the associated tube and a plurality of peripheral lobe portions communicating with the central portion, each of the lobe portions extending generally radially outwardly from the central portion for defining a flow channel alongside the associated tube, each of the lobe portions having a transverse cross-sectional area which varies between the upper and lower surfaces of the plate.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

FIG. 1 is a fragmentary, sectional view of a portion of a nuclear steam generating vessel, illustrating the use of a baffle plate constructed in accordance with and embodying the features of the present invention;

FIG. 2 is an enlarged, fragmentary view of the baffle plate of the present invention, taken generally along the line 2—2 in FIG. 1;

FIG. 3 is a further enlarged top plan view of the baffle plate of FIG. 2, illustrating two of the tube-receiving openings therein;

FIG. 4 is a fragmentary view in vertical section taken along the line 4—4 in FIG. 3; and FIG. 5 is a view similar to FIG. 4, illustrating an alternative form of the baffle plate openings of FIG. 4.

DESCRIPTION OF THE PREFERRED EMBODIMENTS

Referring to FIG. 1, there is illustrated a nuclear steam generating vessel, generally designated by the numeral 10, which has a cylindrical outer wall 11 closed at the lower end by an arcuate bottom portion 12. A circular tube sheet 13 extends transversely across the vessel 10 adjacent to the lower end thereof and encloses the bottom portion 12. A cylindrical central support 14 extends axially of the vessel 10 between the bottom portion 12 and the tube sheet 13 and defines a central blow-down area 15, closed at the lower end thereof by a cover 16. The space below the tube sheet 13 defines two channel head chambers 17, separated by a divider plate (not shown). Each of the chambers 17 is provided with a nozzle 18 (one shown) for communication with an associated nuclear reactor. Each of the chambers 17 is also provided with a manway 19 (one shown) closed by a suitable cover plate, for providing access to the chamber 17.

Disposed above the tube sheet 13 just inside the wall 11 coaxially therewith is a cylindrical tube bundle wrapper 20, the lower end 21 of which terminates a slight distance above the tube sheet 13. Also disposed in the vessel 10 is a bundle of generally inverted U-shaped heat exchanger tubes 22 (one shown) which extend through complementary openings in the tube sheet 13 for communication with the chambers 17, and project upwardly well above the tube sheet 13 and within the tube bundle wrapper 20. Each of the tubes 22 has an inner surface 23 and an outer surface 24 (see FIG. 4), and passes through a corresponding one of a plurality of complementary openings in each of a number of vertically spaced-apart tube support assemblies 25, which provide lateral support for the tubes 22.

In normal operation, primary coolant from the associated nuclear reactor is pumped into one of the chambers 17 and then upwardly through the bundle of tubes 22 to the other chamber 17 and then back to the nuclear reactor. The portions of the tubes 22 above the tube sheet 13 are disposed in heat exchange relationship with a secondary coolant which is converted to steam. The secondary coolant flows generally downwardly through the annular passage defined between the wall 11 and the tube bundle wrapper 20, and then inwardly beneath the lower end 21 of the tube bundle wrapper 20 and back up through the tube bundle, generally parallel to the tubes 22, as indicated by the arrows 26 in FIG. 1, suitable openings being provided in the tube support assemblies 25 to accommodate this flow. While in the arrangement of FIG. 1, the central portion of the vessel 10 has no tubes 22 therein, it will be appreciated that other arrangements are commonly used wherein the tubes 22 extend substantially to the center of the vessel 10.

During this normal operation, as the secondary coolant flow turns upward through the bundle of tubes 22, the flow velocity drops and sludge particles settle out of the secondary coolant and tend to deposit on the upper surface of the tube sheet 13. In order to inhibit the formation of these deposits, there is provided an annular baffle plate 30, which extends transversely of the vessel 10 within the tube bundle wrapper 20, a predetermined distance, e.g., approximately 20 inches, above the tube sheet 13. The baffle plate 30 is designed to have a low flow area ratio, i.e., the ratio of the annular flow area through the baffle to the approach flow area. Thus, the baffle plate 30 presents increased resistance to the upward flow of the secondary coolant, thereby redirecting a portion of that flow radially inwardly in the direction of the arrows 27 in FIG. 1 for entraining sludge particles settling out of the secondary coolant and preventing them from building up on the tube sheet 13. These entrained particles are moved to the center of the vessel 10 where they may continuously or intermittently removed in the blow-down area 15. The present invention relates to the construction of the baffle plate 30 so that it will effectively perform its baffling function, while at the same time inhibiting crevice corrosion of the tubes 22.

Referring in particular to FIGS. 2 through 4 of the drawings, the baffle plate 30 has parallel upper and lower surfaces 31 and 32, and a thickness which approximates the outer diameter of the tubes 22, which may typically be about 0.75 inch. Extending through the baffle plate 30 from the upper surface 31 to the lower surface 32 thereof are a plurality of tube-receiving openings 35, for respectively receiving the tubes 22 therein. It is the configuration of these tube-receiving openings 35 with which the present invention is particularly concerned.

Each of the tube-receiving openings 35 has a generally circular central portion 36 (FIG. 3). Eight equiangularly spaced-apart lands 37 project radially into the central portion 36 of the opening 35 from the perimeter thereof, each of the lands 37 having an inner end surface 38. The lands 37 are substantially identical in construction and are arranged such that the inner end surfaces 38 all lie generally along a common imaginary inner circle 39 having a diameter slightly greater than the outer diameter of the associated tube 22.

The lands 37 of a tube-receiving opening 35 cooperate to define therebetween eight substantially identically-shaped and equiangularly spaced-apart lobe portions 40 of the opening 35, which communicate with the central portion 36 thereof. More particularly, each of the lobe portions 40 has a pair of opposed side walls 41 defined by the adjacent lands 37, and interconnected by an end wall 42, the end walls 42 all lying generally along an imaginary outer circle 44 coaxial with the inner circle 39, but spaced radially outwardly therefrom. The lobe portions 40 respectively define flow channels 43 for permitting flow of the secondary coolant upwardly along the outer surface 24 of the associated tube 22. Thus, each lobe portion 40 has a maximum depth defined by the radial distance between the inner and outer circles 39 and 44.

In operation, each tube 22 is typically located eccentrically in its associated tube-receiving opening 35, so as to be in contact with the inner end surfaces 38 of one or two of the lands 37, as indicated in FIG. 3. The shapes and depth of the lobe portions 40 permits a sufficient volume of secondary coolant to flow therethrough to prevent the coolant from boiling dry in the flow channels 43, thereby effectively preventing crevice corrosion. Furthermore, it will be noted that the circumferential outline of each of the end surfaces 38 is substantially uniform and continuous from the upper surface 31 to the lower surface 32 of the baffle plate 30. Thus, for those lands 37 in contact with the tube 22, the contact is continuous along the entire thickness of the baffle plate 30 (see FIG. 4). Accordingly, the contact forces are spread over a relatively wide area and this substantially eliminates the problem of excessive wear of the tubes 22 by contact with the lands 37.

While the cross-sectional area of the flow channels 43 prevents crevice corrosion, it has been found that it results in a flow area ratio which is large enough to inhibit the intended flow-diversion or baffling function of the baffle plate 30. Accordingly, it is a significant aspect of the present invention that there is formed in the upper surface 31 of the baffle plate 30 a plurality of deformations 45 respectively adjacent to the lobe portions 40 of each opening 35, the deformations 45 serving to displace material of the baffle plate 30 radially inwardly to form displaced tabs 46 of the lobe portions 40, each of these displaced tabs 46 terminating in an inner end wall 47. The end walls 47 all lie generally along a common imaginary circle 49 having a diameter intermediate the diameters of the inner and outer circles 39 and 44 and concentric therewith. The displaced tabs 46 of the lobe portions 40 cooperate to define constricted portions 48 of the flow channels 43, the cross-sectional areas of which are such as to effectively limit the secondary coolant flow a sufficient amount to insure proper baffling operation of the baffle plate 30, while still effectively preventing crevice corrosion.

Many alternative methods of effecting the deformations 45 to form the displaced tabs 46 are possible. Initially, the opening 35 is formed by drilling the circular portions 36 in the baffle plate 30, and then broaching to define the lands 37 and the lobe portions 40. Then, a tool may be used to mechanically cold form the upper surface 31 of the baffle plate 30 adjacent to the lobe portions 40 in towards the center of the opening 35. This could be a hand tool with an impacting hammer on the end. The end of the hammer may have a bit with up to eight "teeth" which will form the displaced tabs 46. A round mandrel could be used to center the tool in the broached hole and provide a bottoming location against which the material formed around the lobe portions 40 may be positioned.

Referring now to FIG. 5, there is illustrated an alternative form of the invention, wherein the displaced tabs 46 of the lobe portions 40 are disposed along the lower surface 32 of the baffle plate 30. More particularly, a plurality of deformations 50 are formed in the lower surface 32 respectively adjacent to the lobe portions 40 for displacing material radially inwardly to form displaced tabs 51 terminating respectively in inner end walls 52 which act to form constricted portions 53 of the flow channels 43. The deformations 50 may be formed in the same manner as was described above with respect to FIGS. 3 and 4 and the operation will be substantially the same.

It will be appreciated that, if desired, the displaced tabs 46 could be formed on both the upper and lower surfaces 31 and 32 of the baffle plate 30. Alternatively, portions of the lands 37 could be deformed to provide the necessary constriction of the flow channels 43 so as to achieve the desired flow area ratio in the lobe portions 40.

In an operating model of the present invention used in connection with a nuclear steam generating plant having tubes of approximately 0.75 inch outer diameter, the difference between the outer diameter of the tubes 22 and the diameter of the inner imaginary circle 39 is approximately 0.030 inch, the circumferential extent of each land end surface 38 is approximately 0.050 inch, the difference between the outer diameter of the tube 22 and the diameter of the outer imaginary circle 44 is approximately 0.100 inch and the difference between the outer diameter of the tube 22 and the diameter of the intermediate imaginary circle 49 is approximately 0.040 inch.

From the foregoing, it can be seen that there has been provided an improved baffle plate construction for a heat exchanger, with a novel arrangement of tube-receiving opening having a multi-lobed configuration with each of the lobes having a restricted flow portion so as to achieve effective baffling performance while at the same time substantially eliminating crevice corrosion effects.

I claim as my invention:

1. In a heat exchanger including a pressure vessel closed at one end by a tube sheet and a plurality of heat exchange tubes within the vessel extending into the tube sheet for heat exchange between a fluid flowing through the tubes and a liquid flowing around the tubes in a flow path extending generally parallel thereto, the improvement comprising: a baffle plate disposed within the vessel and extending transversely thereof in the liquid flow path adjacent to the tube sheet, said baffle plate serving to limit liquid flow parallel to the tubes and to redirect at least a portion of the flow generally parallel to the tube sheet, said baffle plate having parallel upper and lower surfaces and a plurality of tube-receiving openings extending therethrough substantially perpendicular to said upper and lower surfaces for respectively receiving said tubes, each of said openings having a circular central portion dimensioned freely to accommodate the associated tube and a plurality of peripheral lobe portions communicating with said central portion, said baffle plate having a plurality of surface portions cooperating to define said central portions of said openings and being engageable with the associated tubes at the planes of said upper and lower surfaces, each of said lobe portions extending generally radially outwardly from said central portion for defining a flow channel alongside the associated tube, each of said lobe portions having a transverse cross-sectional area which varies between said upper and lower surfaces of said plate.

2. The heat exchanger of claim 1, wherein said lobe portions of each said openings are equiangularly spaced apart around said central portion thereof.

3. The heat exchanger of claim 1, wherein said lobe portions of each of said openings are substantially identical in shape.

4. The heat exchanger of claim 1, wherein each of said openings includes eight of said lobe portions.

5. The heat exchanger of claim 1, wherein each of said lobe portions includes a first portion of relatively large transverse cross-sectional area and a second portion of relatively small transverse cross-sectional area.

6. The heat exchanger of claim 5, wherein said second portion of each of said lobe portions has a length axially of said opening substantially less than the axial length of said first portion.

7. The heat exchanger of claim 5, wherein said second portion of each of said lobe portions is disposed adjacent to said upper surface of said baffle plate.

8. The heat exchanger of claim 7, wherein said upper surface is deformed adjacent to each of said lobe portions to displace material into said lobe portions to form said second portions thereof.

9. The heat exchanger of claim 5, wherein said second portion of each of said lobe portions is disposed adjacent to said lower surface of said baffle plate.

10. The heat exchanger of claim 9, wherein said lower surface of said baffle plate is deformed adjacent to each of said lobe portions for displacing material into said lobe portions to form said second portions thereof.

11. The heat exchanger of claim 1, wherein said central portion of each of said openings has a diameter greater than the outer diameter of the associated tube.

12. In a heat exchanger including a pressure vessel closed at one end by a tube sheet and a plurality of heat exchange tubes within the vessel extending into the tube sheet for heat exchange between a fluid flowing through the tubes and a liquid flowing around the tubes in a flow path extending generally parallel thereto, the improvement comprising: a baffle plate disposed within the vessel and extending transversely thereof in the liquid flow path adjacent to the tube sheet, said baffle plate serving to limit liquid flow parallel to the tubes and to redirect at least a portion of the flow generally parallel to the tube sheet, said baffle plate having parallel upper and lower surfaces and a plurality of generally circular tube-receiving openings extending therethrough substantially perpendicular to said upper and lower surfaces for respectively receiving said tubes, said baffle plate having a plurality of equiangularly spaced apart lands extending generally radially into each of said openings and cooperating to define therebetween a plurality of peripheral lobe portions of said opening, the inner ends of said lands lying generally along an inner circle having a diameter slightly greater than the outer diameter of the associated tube, and each of said lobe portions extending radially outwardly from said inner circle to a maximum depth which varies between said upper and lower surfaces of said plate.

13. The heat exchanger of claim 12, wherein said baffle plate has an even number of said lands extending into each of said openings.

14. The heat exchanger of claim 13, wherein said baffle plate has eight of said lands extending into each of said openings.

15. The heat exchanger of claim 12, wherein said lands in each of said openings are substantially identical.

16. The heat exchanger of claim 12, wherein each of said lands has an inner end surface which extends continuously from said upper surface to said lower surface perpendicular thereto and is disposed for contact along the entire axial extent thereof with the outer surface of the associated tube.

17. The heat exchanger of claim 12, wherein said lands are dimensioned and arranged so that as many as two of said lands in any one opening can simultaneously contact the associated tube.

18. The heat exchanger of claim 12, wherein each of said lobe portions has a minimum depth portion and a maximum depth portion, the length of said minimum depth portion axially of said opening being substantially less than the axial length of said maximum depth portion.

19. The heat exchanger of claim 18, wherein said minimum depth portion of each of said lobe portions is disposed adjacent to said upper surface.

20. The heat exchanger of claim 18, wherein said minimum depth portion of each of said lobe portions is disposed adjacent to said lower surface.

* * * * *